US006758241B1

(12) United States Patent
Pfund et al.

(10) Patent No.: US 6,758,241 B1
(45) Date of Patent: Jul. 6, 2004

(54) SAFETY VALVE

(75) Inventors: Stefan Pfund, Winnenden (DE); Günter Baldauf, Kernen (DE)

(73) Assignee: IMI Norgren-Herion Fluidtronic GmbH & Co. KG (DE)

( * ) Notice: Subject to any disclaimer, the term of this patent is extended or adjusted under 35 U.S.C. 154(b) by 73 days.

(21) Appl. No.: 10/110,489

(22) PCT Filed: Sep. 28, 2000

(86) PCT No.: PCT/DE00/03376

§ 371 (c)(1),
(2), (4) Date: Apr. 15, 2002

(87) PCT Pub. No.: WO01/29429

PCT Pub. Date: Apr. 26, 2001

(30) Foreign Application Priority Data

Oct. 15, 1999 (DE) ..... 199 49 874

(51) Int. Cl.[7] ..... F15B 13/043
(52) U.S. Cl. ..... 137/596.16; 91/424
(58) Field of Search ..... 91/424; 137/596.16, 137/596.14

(56) References Cited

U.S. PATENT DOCUMENTS

| | | | |
|---|---|---|---|
| 4,353,392 | A | 10/1982 | Ruchser et al. |
| 5,007,447 | A | 4/1991 | Penitot et al. |
| 5,927,324 | A | 7/1999 | Russell et al. |

FOREIGN PATENT DOCUMENTS

| | | |
|---|---|---|
| DE | 2 121 528 | 11/1972 |
| DE | 30 05 547 | 10/1981 |
| DE | 40 04 406 | 8/1990 |
| DE | 90 14 789 | 2/1991 |
| DE | 196 22 198 | 12/1997 |
| EP | 497 450 | 8/1992 |
| GB | 1 380 771 | 1/1975 |

*Primary Examiner*—Gerald A. Michalsky
(74) *Attorney, Agent, or Firm*—Ostrolenk, Faber, Gerb & Soffen, LLP

(57) ABSTRACT

A safety valve for compressed air-operated consumers, including a valve housing having bores, and two direction control valves connected in parallel, each of the control valves having a working piston and a valve head connected to the piston. Two pilot control valves are operatively connected to the directional control valves so that each of the direction control valves is switchable by one of the pilot control valves. Each of the two valve heads is guided in a respective one of the bores in the valve housing. The housing has two cross-channels arranged to connect crosswise to each other. A first one of the pilot valves has a valve seat connected via a first pilot channel in the housing to one of the cross-channels which proceeds from the bore of one of the valve heads. A second of the pilot valves has a valve seat connected via a second pilot channel to another of the cross-channels which proceeds from the bore of another of the valve heads. A compressed-air switching element is provided between two corresponding points at each of the two directional control valves so that the safety valve can be blocked when pressures at the two points are different and turned back on again only by external compressed air-operated actuation of at least one of the two switching elements.

10 Claims, 9 Drawing Sheets

SAFETY VALVE

PRIORITY CLAIM

This is a U.S. national stage of application No. PCT/DE00/03376, filed on Sep. 28, 2000. Priority is claimed on that application and on the following application:

Country: Germany, application No.: 199 49 874.1, Filed: Oct. 15, 1999.

BACKGROUND OF THE INVENTION

The invention pertains to a safety valve for a consumer operated by compressed air.

A safety valve of this type is described, for example in DE 3,005,547 C2 and in DE 196-22,198 A1.

Safety valves of this type are used, for example, to actuate the clutches and brakes of presses. In the case of a switching malfunction in which the two directional control valves assume different switching positions, the feed in these types of safety valves is blocked, and the line leading to the consumer is vented, so that no residual pressure remains in this line. To determine a switching malfunction of this kind and to turn off the system, it is provided in the safety valve described in DE 3,005,547 C2 that the control air for the pilot valves is taken not directly from the feed line but rather from cross-channels, which connect the two bores in which the valve disks are guided to each other in a crosswise manner. As a result, it is possible for the safety valve to monitor itself dynamically at all times.

SUMMARY OF THE INVENTION

The task of the invention is to improve a safety valve of the general type in question in such a way that, after the malfunction has been corrected, the valve can be reset or turned back on easily, preferably without the need for electric switching elements.

The task is accomplished by a safety valve for compressed air-operated consumers with two directional control valves connected in parallel, each with its own working piston and its own valve head connected to the piston. Each of the directional control valves is switchable by its own pilot control valve. Each of the two valve heads is guided in a bore in a valve housing. The bores are connected crosswise to each other by two cross channels. The valve seat of the first pilot valve is connected via a pilot channel to one of the cross channels which proceeds from the bore of the valve head. The valve seat of the second pilot valve is connected via a second pilot channel to the other cross channel which proceeds from the bore of the other valve head. A compressed-air switching element is provided between two corresponding points at each of the two directional control valves, by means of which switching elements the safety valve can be blocked when the pressure at these two points are different and turn back on again only by the external compressed air-operated actuation of at least one of the two switching elements. The present invention offers not only the advantage that the safety valve can be blocked when a problem occurs in one of the two directional control valves but also advantage that the valve can be turned back on again by external actuation of the switching element, which can be done by the use of a key-operated switch, i.e., manually, or by shutting off the system pressure completely.

Thus, for example, it is especially advantageous that each switching element has a device for dynamically monitoring the pressure differences in at least two pressure lines, each of these devices being provided with a piston-cylinder unit, which, when there is a difference between the pressures in the two pressure lines, connects the inlet of one of the two directional control valve to the atmosphere. Connecting the inlet of one of the two directional control valves to the atmosphere has the result of preventing the unintentional and unwanted re-actuation of the safety valve.

There is preferably a switching element in each of the pilot channels.

BRIEF DESCRIPTION OF THE DRAWINGS

Additional advantages and features of the invention are the objects of the following description and of the drawing.

DETAILED DESCRIPTION OF THE PREFERRED EMBODIMENTS

Figure 1:
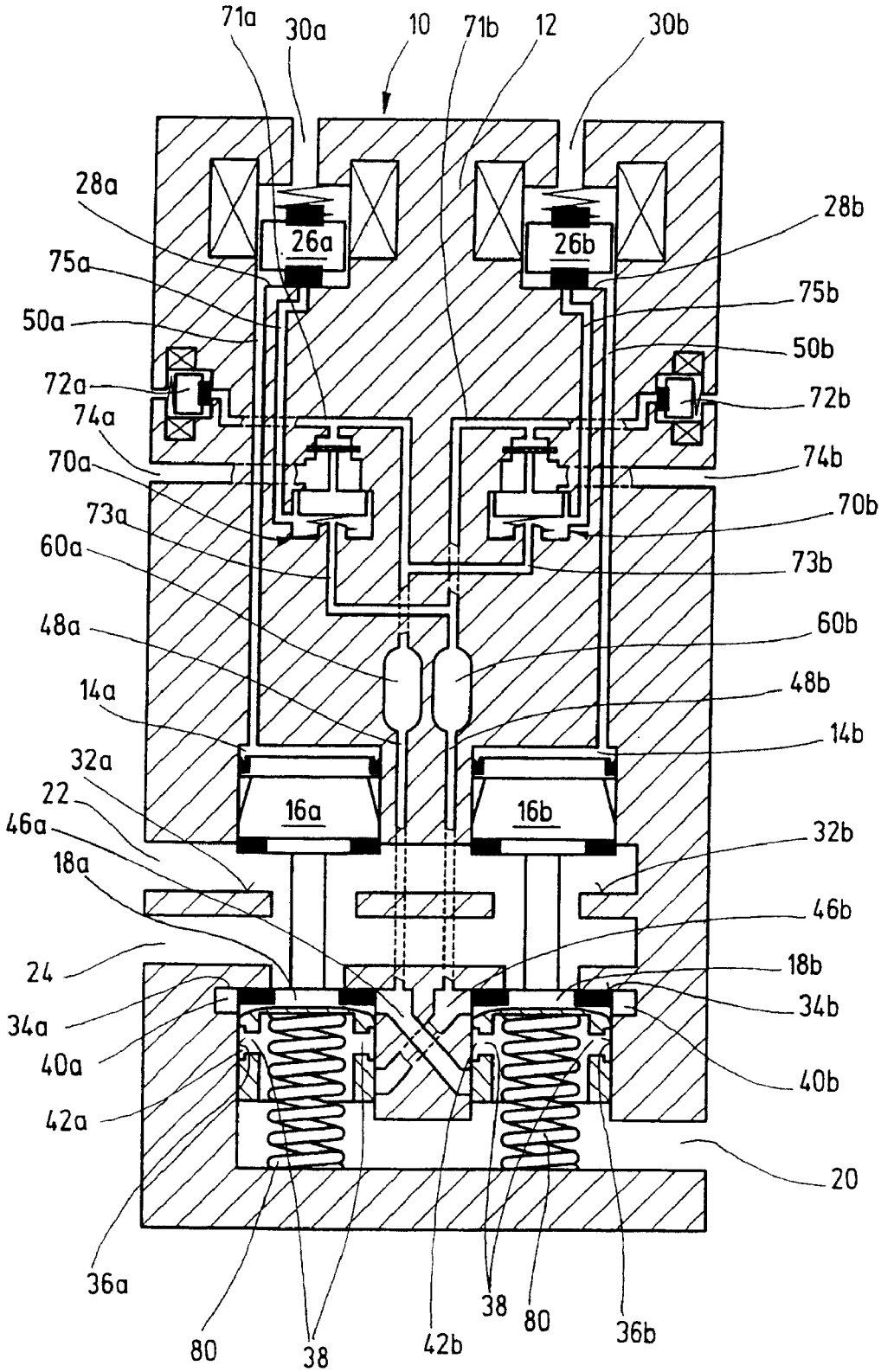
FIG. 1 is a sectional diagram of a safety valve according to the invention in the rest position.

A safety valve 10, shown in FIGS. 1–5, comprises a housing 12, in which two directional control valves, connected in parallel, are installed. Each of the two directional control valves has a working piston 16*a* and 16*b* and a valve head 18*a*, 18*b*, rigidly connected to the piston. The housing 12 has a feed port 20 for compressed air, a return port 22, and a consumer port 24. Each directional control valve has its own electromagnetically actuated pilot valve 26*a*, 26*b* with valve seats 28*a*, 28*b* and vent openings 30*a*, 30*b*. The piston-shaped valve heads 18*a*, 18*b* are guided in bores 36*a*, 36*b* in the housing 12 with the result that the valve seats 34*a*, 34*b* can be opened and closed. The valve seats 32*a*, 32*b* are opened and closed by the working pistons 16*a*, 16*b*.

The two valve heads 18*a*, 18*b* have transverse bores 38, which open out into a ring-shaped channel 42*a*, 42*b*.

In the housing 12, furthermore, two channels 46*a*, 46*b*, called "cross-channels" in the following, are provided, which connect the two bores 36*a*, 36*b* to each other. From these cross-channels 46*a*, 46*b*, pilot channels 48*a*, 48*b* branch off, which lead ultimately via the storage chambers 60*a*, 60*b* and devices for the dynamic monitoring of pressure differences, to be described in greater detail further below and referred in the following in brief as "memory valves" 70*a*, 70*b*, to the valve seats 28*a*, 28*b* of the pilot valves 26*a*, 26*b*. From the pilot valves, furthermore, channels 50*a*, 50*b* lead to the working pistons 16*a*, 16*b*, i.e., to their working chambers 14*a*, 14*b*.

The memory valves 70*a*, 770*b* are connected in such a way that the memory valve 70*a* assigned to the one directional control valve or to one of the two directional control valves connected in parallel has a first input line 71*a*, which is connected to an electromagnetically actuated valve 72*a* and also to the second input line 73*b* of the other memory valve 70*b*. This memory valve 70*a* also has a second input line 73*a*, which is connected to the memory chamber 60*b*. The memory valve 70*b* assigned to the other directional control valve has a first input line 71*b*, which is connected in turn to an electromagnetically actuated valve 72*b* and also to the second input line 73*a* of the other memory valve 70*a*, whereas its second input line 73*b* is connected to the first input line 71*a* of the memory valve 70*a*. The memory valves 70*a*, 70*b* are thus also connected via the memory chambers 60*a*, 60*b* to the parallel directional control valves in a crosswise manner by the channels 48*a* and 48*b*.

Figure 6:
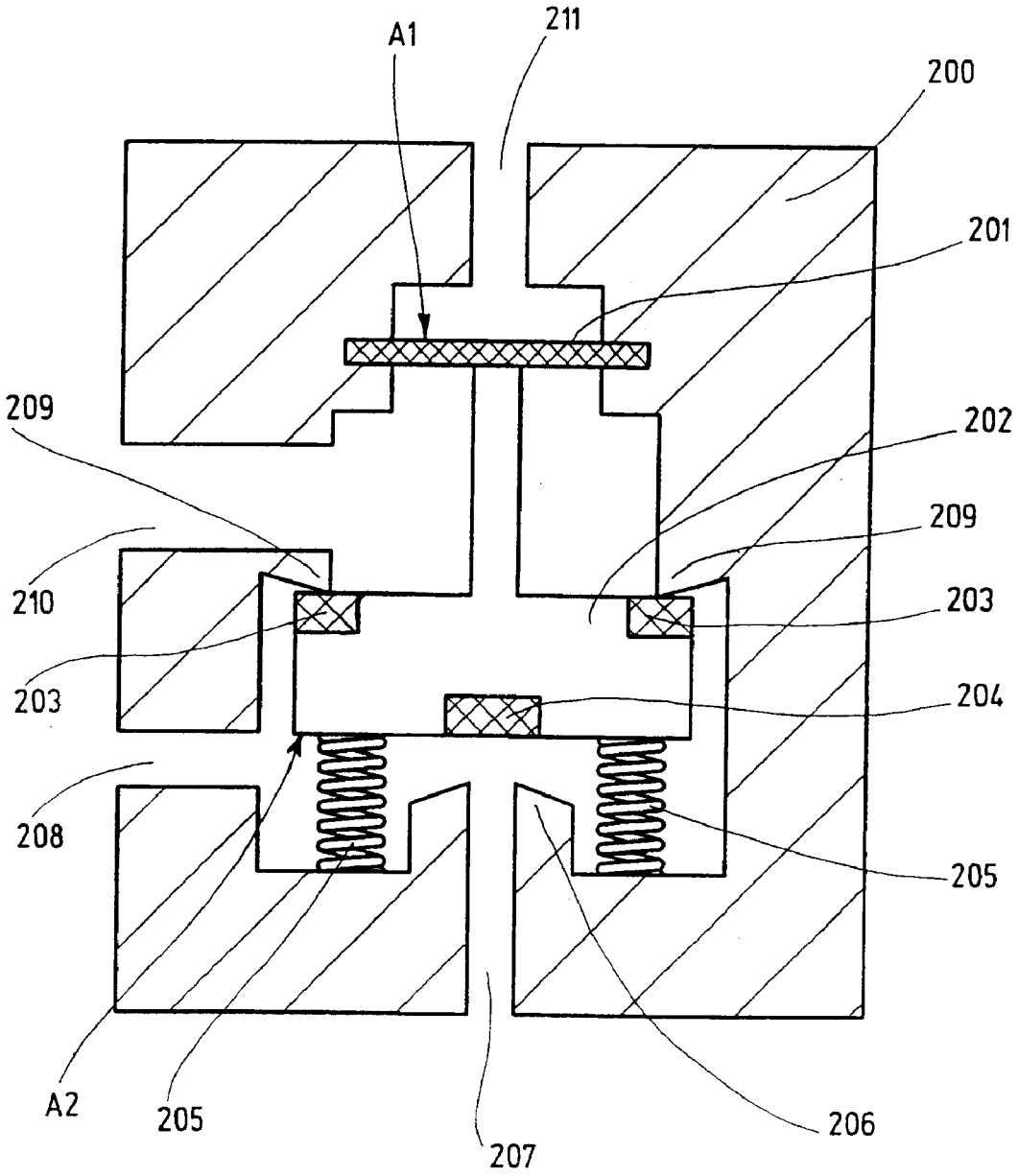
FIG. 6 shows a device, used in a safety valve according to the invention to monitor pressure differences in two pressure lines, in the rest position.
Figure 7:
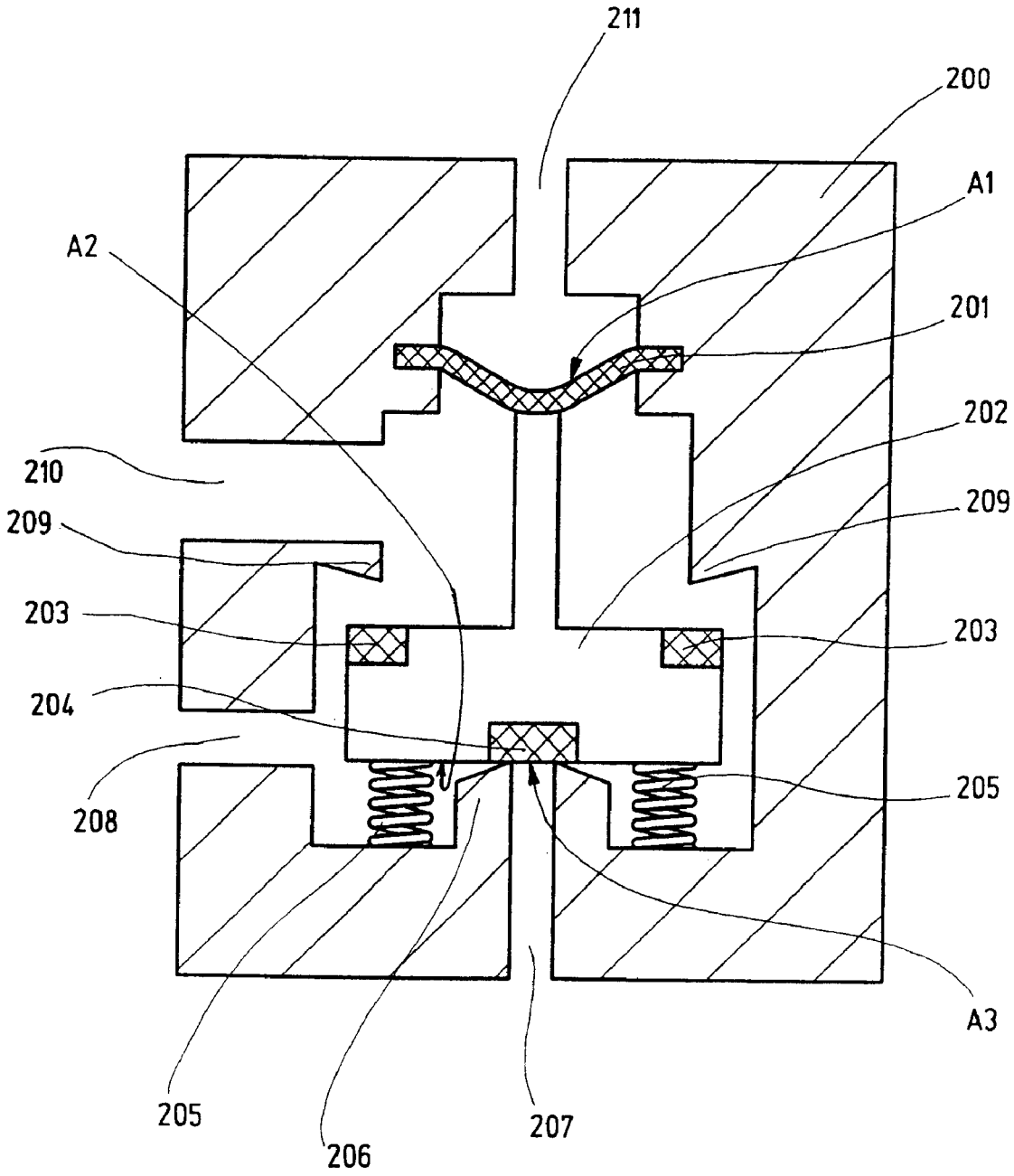
FIG. 7 shows the device illustrated in FIG. 6 in the memory position.
Figure 8:
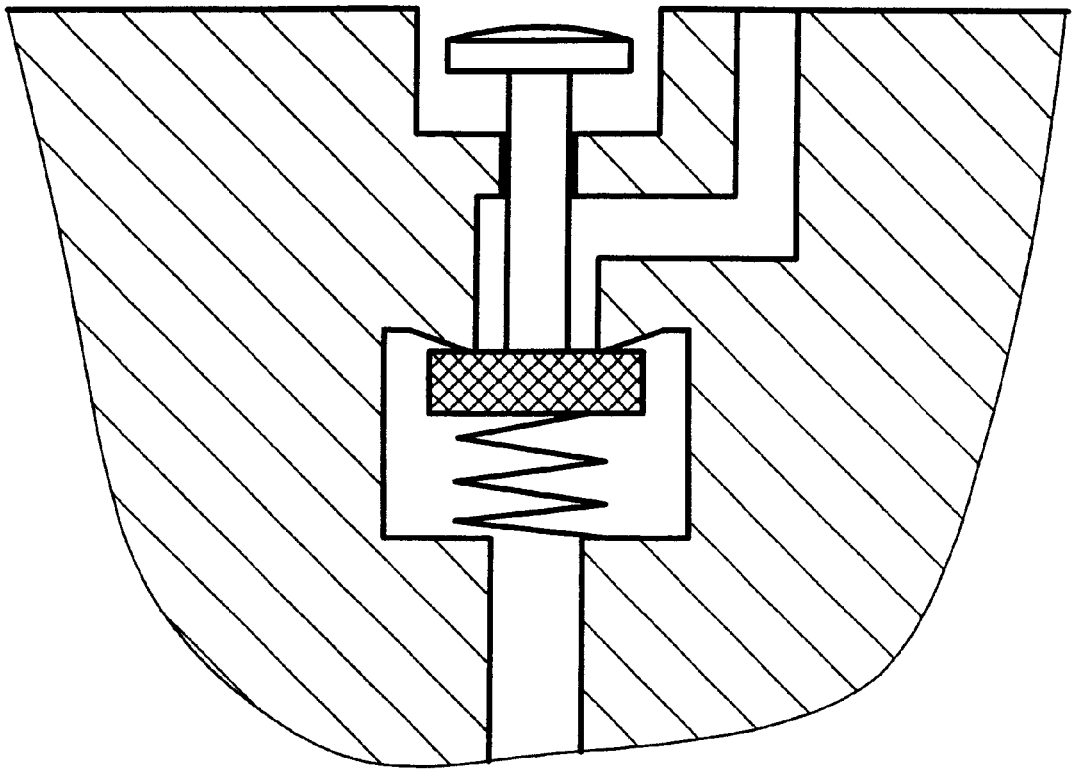
FIG. 8 shows a mechanically activated valve in a rest position.
Figure 9:
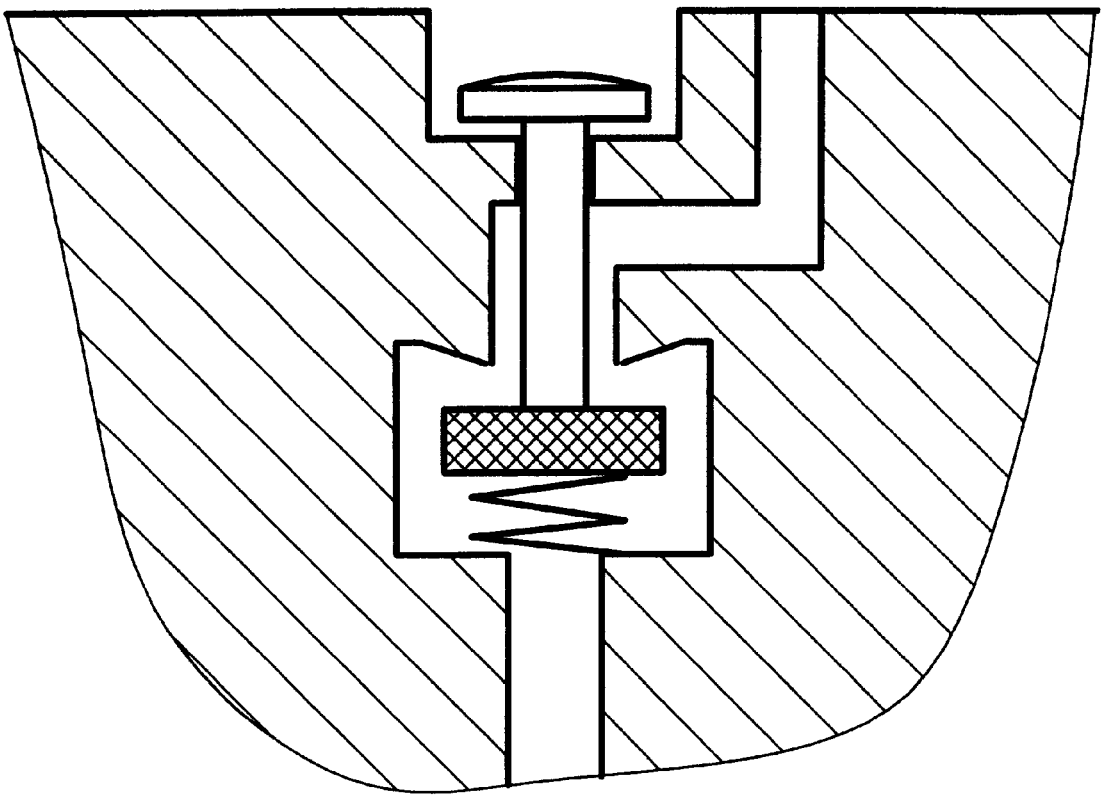
FIG. 9 shows the valve of FIG. 8 in an open position.

The way in which the memory valves 70*a*, 70*b* operate is explained first on the basis of FIGS. 6 and 7, so that the way in which the safety valve itself operates can be better understood.

The memory valve for the dynamic monitoring of pressure differences and for their storage in memory, shown in FIGS. 6 and 7, comprises a housing 200 with a port 207, which is connected to the second input line 73*a*, 73*b*, and a port 211, which is connected to the first input line 71*a*, 71*b*. In the housing 200, a piston 202 is free to slide in an opening in the housing 200 against the restoring force of restoring springs 205.

The memory valve also comprises a port 208 and a port 210, where the port 208, depending on the position of the piston 202, is connected either to the port 207 or to the port 210, which is itself connected to the atmosphere. In the case of the safety valve shown in FIGS. 1–5, the port 208 is connected to the pilot valves 26*a*, 26*b*, whereas the port 210 is connected to the return line 22 or to the atmosphere.

On an end facing away from the restoring springs 205, the piston 202 is sealed off by a membrane 201, which is mounted in the housing 200 and forms an effective pressure surface A1, by means of which the piston 202 can be subjected to the pressure which prevails at the port 211.

On the side of the piston 202 facing the springs 205, the effective pressure surface is formed by the pressure surface A2 of the piston 202, the surface on this side being larger. A side of the piston facing away from the springs cooperates with a seat 209. In addition, the pressure surface can also be formed, for example, by a piston with a sealing element, which, for example, can be in the form of a lip ring.

The elastic force produced by the restoring springs 205 holds the piston 202 in the rest position shown in FIG. 6. For this purpose, the piston 202 has sealing surfaces 203 on the side facing away from the restoring springs 205, which surfaces cooperate with the valve seat 209.

On the side facing the restoring springs 205, furthermore, the piston 202 has a sealing surface 204, which cooperates with the valve seat 206.

The memory valve stores a signal whenever there is pressure at port 211 and simultaneously an absence of pressure at port 207 or whenever there is a pressure difference here, as will be described in greater detail below.

If the two ports 207 and 211 are both under pressure, the piston 202 remains in its rest position as shown in FIG. 6. The elastic force of the restoring springs 205 and the force being exerted on the surface A2, this being the force produced by the fluid pressure at port 207 and acting on the valve seat 209, results in a force which holds the piston 202 in the rest position against the force produced by the fluid pressure acting on the membrane 201. It is obvious that the two effective surfaces A1, A2 and the spring constants will be selected so that, when the pressures at the ports 207 and 211 are the same, the effective surface A2 minus the effective surface A1 results in a force sufficient to hold the piston 202 in the rest position. In this rest position, the fluid pressure present at the port 208 is the same as that at the port 207. The port 210, as mentioned above, is connected to the atmosphere or to the return line 22.

The memory function of the memory valve operates as follows. When the fluid pressure falls at the port 207 and thus also falls at port 208—where the pressure difference at which a memory process is initiated can be determined by the interaction of the surfaces A1 and A2 and the elastic force of the springs 205—then the only force which remains to keep the piston 202 in this rest position is the sum of the elastic force of the springs and whatever resultant force is still present at ports 207, 208, which is now lower than the pressure at port 211. But because the force present at the membrane 201 is greater than the elastic force of the springs plus whatever force is still present at ports 207, 208, which is now less than that at the port 211, port 211 continuing to be under the full system pressure, the piston 202 moves downward toward the valve seat 206, and the surface A3 assumes the memory position shown in FIG. 7.

When now a fluid pressure is again present at the ports 207 and 208 or when the pressure starts to increase there again, only a weak upward-directed force will be developed, this force being equal to the product "seat surface A3 of the valve seat 206 times the fluid pressure". The size of the seat surface A3 of the valve seat 206 is calculated in such a way that this force, together with the force produced by the restoring springs 205, is not sufficient to move the piston 202 against the downward-directed force, which is equal to the product "fluid pressure times membrane surface A1". The equalization of the pressure between port 207 and port 211 does not lead to the resetting or "deletion" of the memory status of the device and the return to the rest position. The pressure difference which has occurred remains, so to speak, "stored" by the position of the piston, which now connects the port 208 via the port 210 to the atmosphere.

A resetting of the memory valve, that is, a "delete" function, can be achieved only by venting the space above the membrane 201 through the port 211, so that the springs 205 and the fluid pressure present at the seat surface A3 are sufficient to move the piston 202 back into its starting or rest position. When this happens, the stored signal is deleted. This venting can be accomplished via the electromagnetically actuated reset valves 72*a*, 72*b*, as will be described below in conjunction with FIGS. 1–5.

In FIGS. 1–5, identical elements are designated by the same reference symbols.

Figure 2:
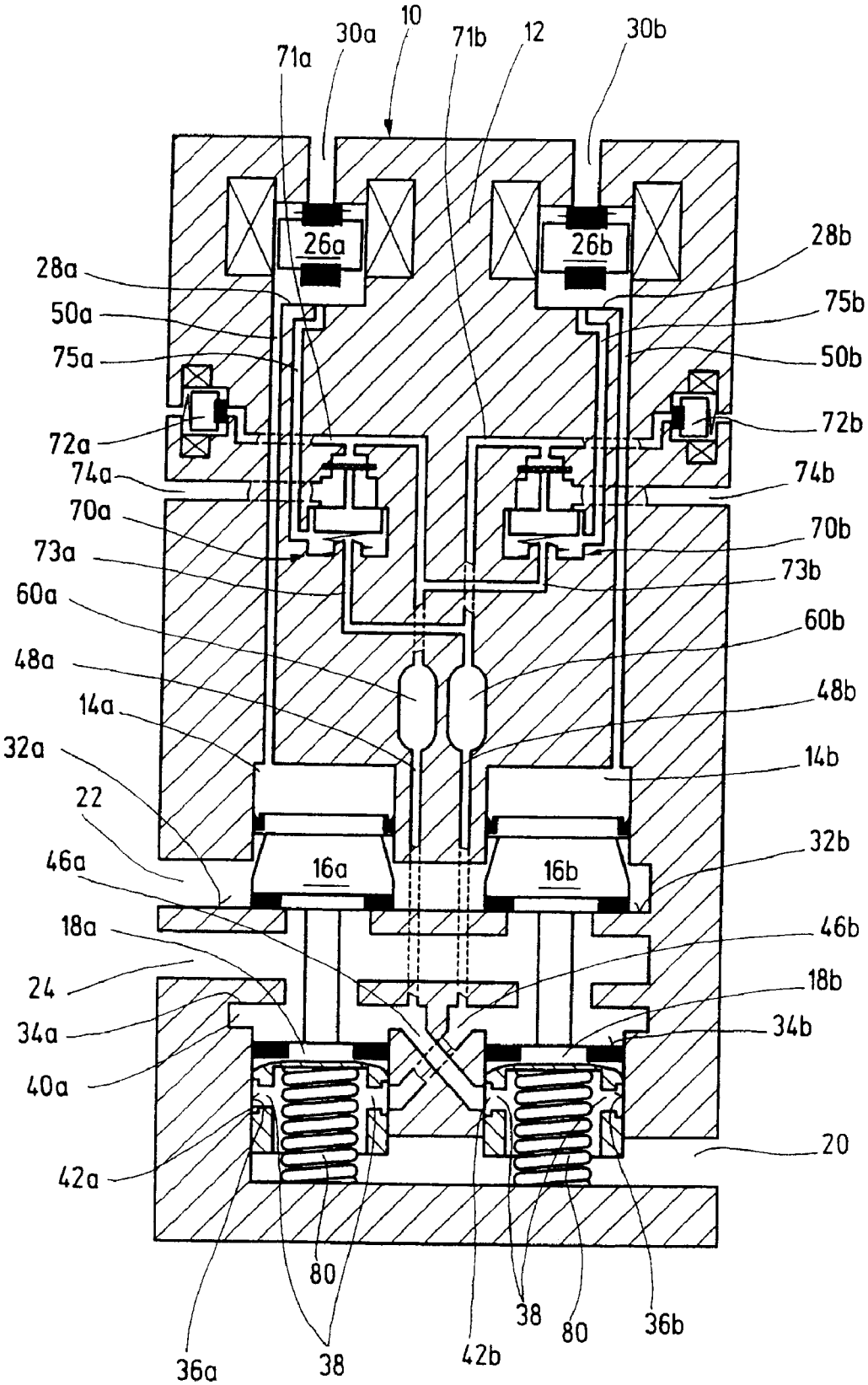
FIG. 2 shows a safety valve in the switched position.

The safety valve functions in the following way. FIG. 1 shows the safety valve in its rest position. In the rest position, the pilot valves 26*a*, 26*b* are closed, and the working chambers 14*a*, 14*b* of the working pistons 16*a*, 16*b* are vented via the channels 50*a*, 50*b* and the vent openings 30*a*, 30*b* of the pilot valves 26*a*, 26*b*. The valve heads 18*a*, 18*b* are thus pushed by the compression springs 80*a*, 80*b* (and the pressure medium) against the seats 34*a*, 34*b*, which are thus closed. The valve seats 32*a*, 32*b* of the working pistons are open, so that the consumer port 24 is vented to the return port 22. When the pilot valves 26*a*, 26*b* are now switched, then, as shown in FIG. 2, their valve seats 28*a*, 28*b* are opened, and their vent openings 30*a*, 30*b* are closed. The volume of the pilot channels 48*a*, 48*b*, of the storage chambers 60*a*, 60*b*, of the second connecting lines 73*a*, 73*b*, and of the connecting lines 75*a*, 75*b* of the memory valves 70*a*, 70*b* is large enough to ensure that the compressed air present in the pilot channels 48*a*, 48*b*, in the storage chamber 60*a*, 60*b*, in the second connecting lines 73*a*, 73*b*, and in the connecting lines 75*a*, 75*b*, which air enters the working chambers 14*a*, 14*b* of the working pistons 16*a*, 16*b* via the valve seats 28*a*, 28*b* and the channels 50*a*, 50*b*, is sufficient to switch over the working pistons 16*a*, 16*b*, so that they occupy the position shown in FIG. 2, in which the valve seats 32*a*, 32*b* of the working pistons are closed and the valve seats 34*a*, 34*b* of the valve heads 18*a*, 18*b* are opened.

The compressed air flows now from the feed line 20 into the hollow-bored valve heads 18*a*, 18*b*, through the transverse bores 38, and into the ring-shaped channels 42*a*, 42*b*. From there, the air flows through the cross-channels 46*a*, 46*b* into the ring-shaped channels 40*a*, 40*b*, and from these through the valve seats 34*a*, 34*b* to the consumer via the consumer port 24. Simultaneously, compressed air flows from the cross-channels 46*a*, 46*b* and the ring-shaped channels 40*a*, 40*b* into the pilot channels 48*a*, 48*b*, from there to the storage chambers 60*a*, 60*b*, and then onward to the memory valves 70*a*, 70*b*, where the compressed air exerts the same pressure in both the inlet lines 71*a*, 71*b* and the inlet lines 73*a*, 73*b* of the memory valves 70*a*, 70*b*. In this state, the memory valves 70*a*, 70*b* are in the above-described rest position, so that the valve seats 28*a*, 28*b* are filled with compressed air at the full feed air pressure, so that the working pistons 16*a*, 16*b* of the parallel-connected valves are kept in the switched position via the lines 50*a*, 50*b*. When the pilot valves 26*a*, 26*b* are now switched back again and their valve seats 28*a*, 28*b* are closed, the vent openings 30*a*, 30*b* open simultaneously, and the working chambers 14*a*, 14*b* of the working pistons 16*a*, 16*b* are vented via the vent openings 30*a*, 30*b* of the pilot valves and the channels 50*a*, 50*b*.

The two directional control valves then switch back into the rest position shown in FIG. 1, because compressed air is no longer acting on the working pistons 16*a*, 16*b*, and therefore the springs 80 are able to push the valve heads 18*a*, 18*b* back onto their valve seats 34*a*, 34*b*. The pilot channels 48*a*, 48*b*, however, are filled with compressed air at the full feed pressure, so that, when another switch is initiated, this pressure is able to move the working pistons 16*a*, 16*b* back into the position shown in FIG. 2.

Figure 3:
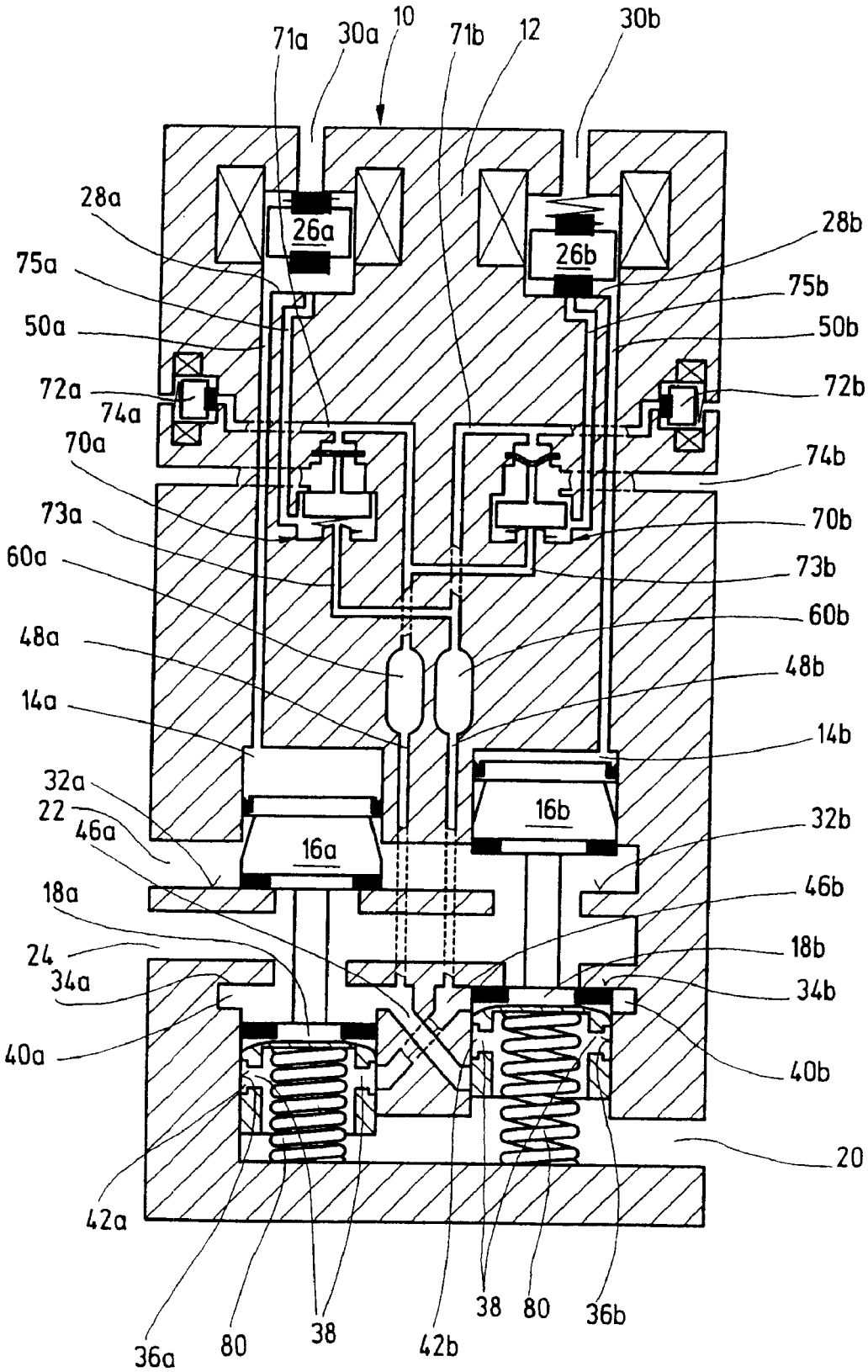
FIG. 3 shows the safety valve in an incorrectly switched position.

In the case of the malfunction shown in FIG. 3, it is assumed that the magnet of the pilot valve 26*a* is excited, whereas the magnet of the pilot valve 26*b* is not. Thus the valve seat 28*a* is open, but the valve seat 28*b* is closed. Compressed air is able to act on the working piston 16*a* via the pilot channel 48*b*, the second inlet line 73*a*, the memory valve 70*a*, the line 75*a*, the valve seat 28*a*, and the channel 50*a*, whereas the working piston 16*b* as shown in FIG. 3 is not switched over. Thus the valve seat 34*b* is closed, but the valve seat 34*a* remains open. In this position, however, it is impossible for any compressed air to flow to the valve seat 34*a*, because the cross-channel 46*a* leading to the valve seat 34*a* is blocked by the piston-shaped valve head 18*b*. The consumer port 24 is vented via the open valve seat 32*b* to the return line 22. It is impossible for any pressure to build up at the consumer port 24.

Although some compressed air enters the cross-channel 46*b* via the valve head 18*a*, the transverse bore 38, and the ring channel 42*a*, it cannot continue to flow onward from there, because the valve head 18*b* is in the closed position. The full feed pressure, however, continues to act on the working piston 16*a* via the pilot channel 48*b*, which is connected to the cross-channel 46*b*.

The pilot channel 48*a*, however, is vented via the ring channel 40*a* and the open valve seats 34*a*, 32*b* to the return line 22, so that no pressure can build up in the pilot channel 48*a*. Any pressure which may already be present decreases to the return pressure, e.g., atmospheric me pressure.

Because of the way in which the memory valves 70*a*, 70*b* are connected, the memory valve 70*a* in this situation is in its rest position, i.e., the position in which the line 73*a* is connected via the line 75*a* to the valve seat 28*a* of the solenoid valve 26*a*, so that the pressurized fluid is able act on the valve seat 28*a* via the pilot line 48*b* and the storage chamber 60*b*. The memory valve 70*b*, however, has been switched over into its memory position, because the pressures in the two lines 71*b* and 73*b* are not the same. Whereas there is an absence of pressure in line 73*b*, because this line is connected via the memory chamber 60*a* and the pilot channel 48*a* to the return line 22 and is thus vented, the line 71*b* is connected via the storage chamber 60*b* and the lines 48*b*, 46*b*, the ring channel 42*a*, and the transverse bore 38 to the feed port 20 for compressed air. In this case, the port 210 (compare FIGS. 6 and 7) of the memory valve 70*b* is connected via the line 74*b* to the atmosphere. If the pilot valve 26*b* were now to be switched over by some means or other so as to open the valve seat 28*b*, it would still be impossible for the working piston 16*b* to be switched, because the channel 50*b* is connected to the line 74*b* via the channel 75*b* and the memory valve 70*b*, which remains in the memory position.

Figure 4:
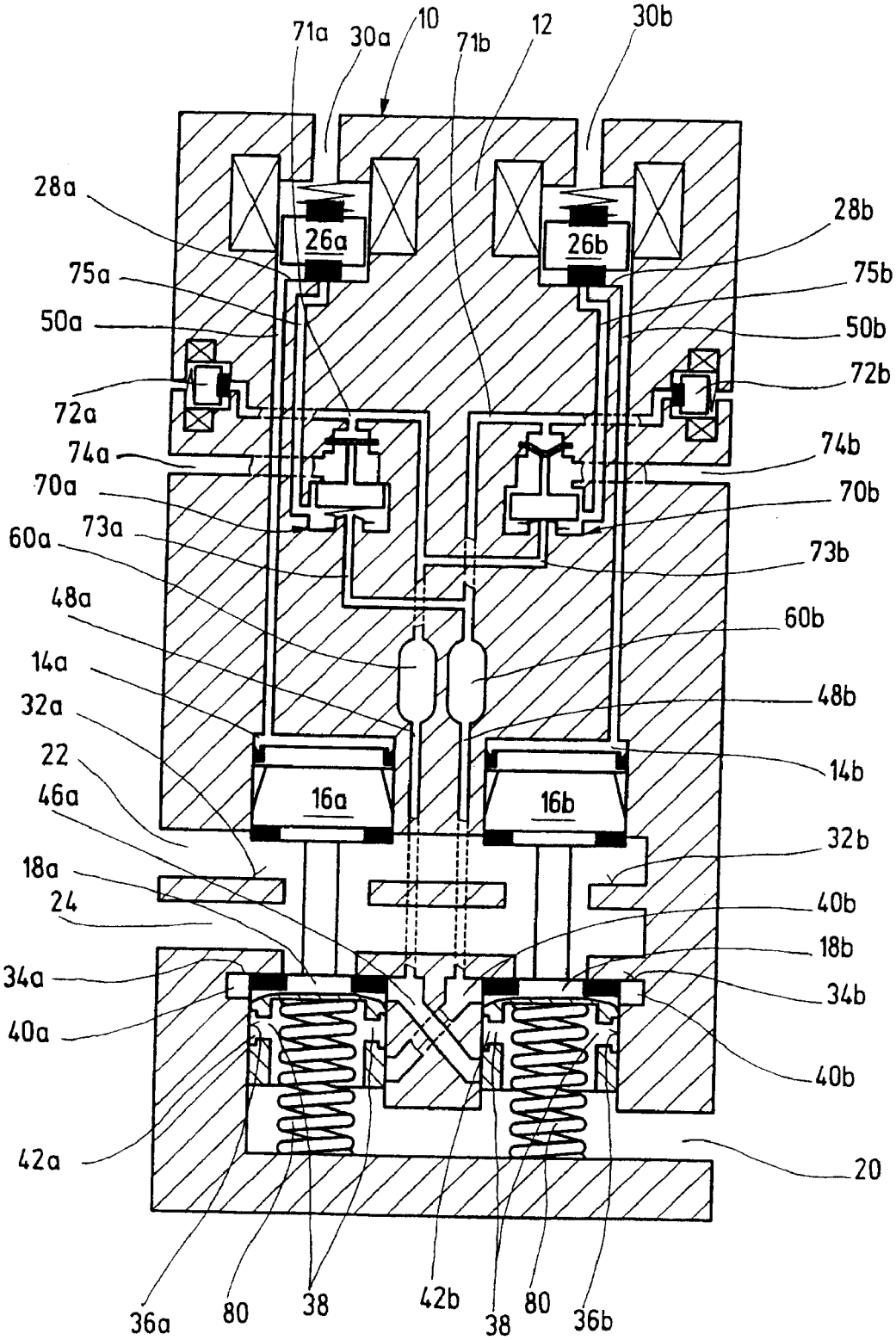
FIG. 4 shows the safety valve in the rest position after the occurrence of a fault and the storage of that fault in memory.
Figure 5:
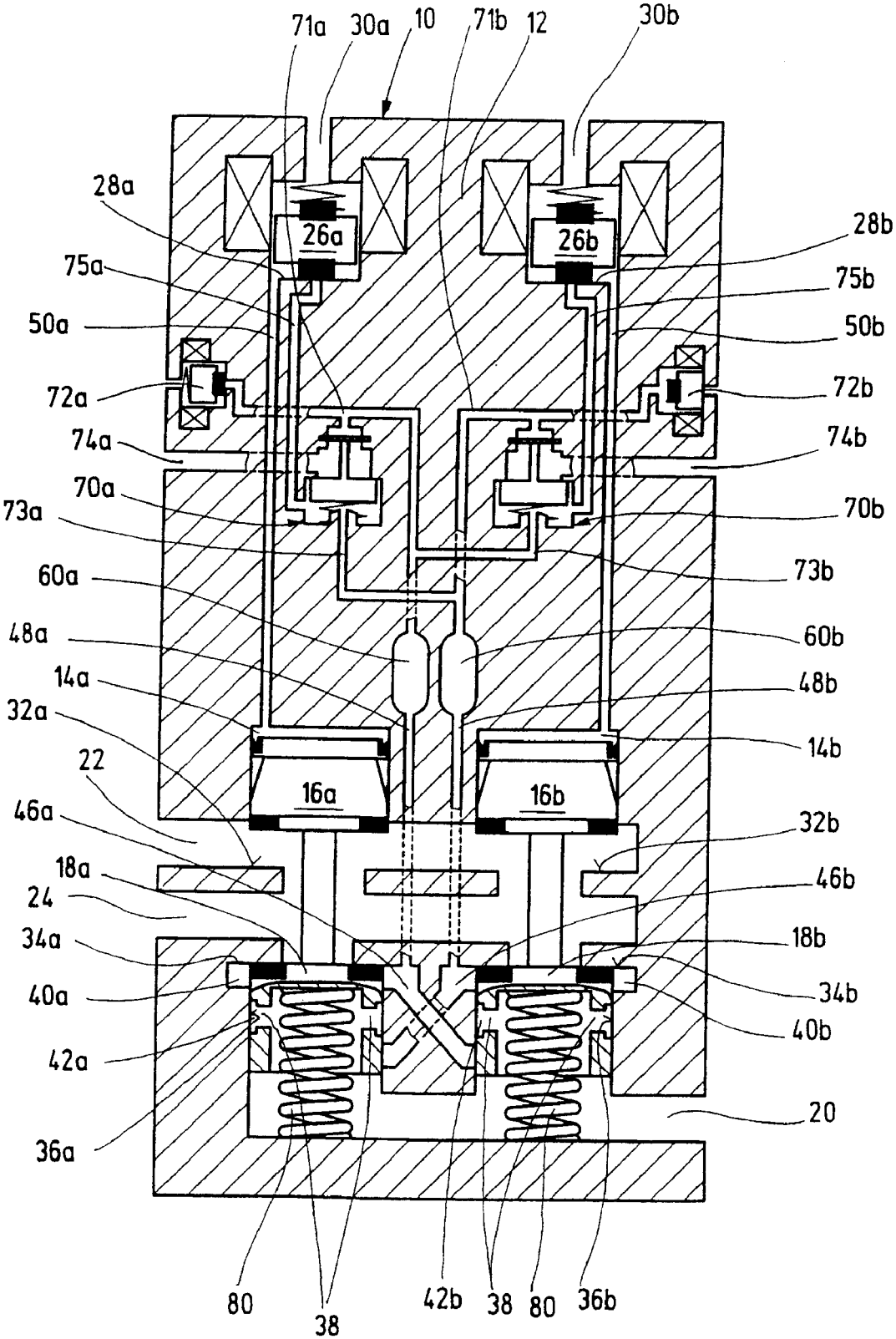
FIG. 5 shows the resetting of the fault in the safety valve according to FIGS. 1–4.

Even if the working position 16*a* were to move back to its rest position, as illustrated in FIG. 4, the malfunction would remain in memory, because the memory valve 70*b* would still remain in the position shown in FIG. 3, even though the pressures in the lines 71*b* and 73*b* at the memory valve 70*b* would be equalized. It is possible for the safety valve to be actuated again only after the memory valve 70*b* has been reset through actuation of the reset valve 72, as shown in FIG. 5, that is, by venting the line 71*b*, which allows the memory valve to return to its rest position. This resetting can, for example, be accomplished by a key-operated switch or by some other type of manual actuation.

The device can also be reset by shutting off the system pressure. If this approach is taken, it would be possible, for example, to omit the solenoid valve or the mechanically actuated valve actuated by, for example, a key-operated switch.

What is claimed is:

1. A safety valve for compressed air-operated consumers, comprising: a valve housing having bores; two direction control valves connected in parallel, each of the control valves having a working piston and a valve head connected to the piston; each of the two pilot control valves operatively connected to the directional control valves so that direction control valves is switchable by one of the pilot control valves, each of the two valve heads being guided in a respective one of the bores in the valve housing, the housing having two cross-channels arranged to connect crosswise to each other, a first one of the pilot valves having a valve seat connected via a first pilot channel in the housing to one of the cross-channels which proceeds from the bore of one of the valve heads, a second of the pilot valves having a valve seat connected via a second pilot channel to another of the cross-channels which proceeds from the bore of another of the valve heads; and a compressed-air switching element provided between two corresponding points at each of the two directional control valves so that the safety valve can be blocked when pressures at the two points are different and turned back on again only by external compressed air-operated actuation of at least one of the two switching elements.

2. A safety valve according to claim 1, wherein one of the switching elements is provided in each pilot channel, the two points being inlets to the switching elements, each switching element being connected in a crosswise manner to corresponding inlets of the other switching element.

3. A safety valve according to claim 2, wherein each switching element is a device for dynamic monitoring of the pressure difference in at least two pressure lines, each device including a piston-cylinder unit which connects one of the two directional control valves the atmosphere when pressures in the two pressure lines are different.

4. A safety valve according to claim 3, wherein the device for the dynamic monitoring of the pressure differences in the at least two pressure lines comprises a piston-cylinder unit with two opposing pressure surfaces of different sizes, one of the pressure surfaces being actable upon by pressurized fluid through one of the pressure lines, another of the pressure surfaces being actable upon by pressurized fluid through the other pressure line, the piston-cylinder unit further comprising a piston movable against a restoring force of at least one restoring spring so that, when pressure in the two pressure lines is equal, the restoring force of the at least one restoring spring plus a force acting on the pressure surface facing the at least one restoring spring is equal to the force acting on the pressure surface facing away form the restoring spring so that the piston-cylinder unit remains in a rest position, the piston-cylinder unit being operative to switch over to a memory position in response to a reduction in the force acting on the side facing the at least one restoring spring, in which memory position the force acting on the pressure surface facing away from the at least one restoring spring is greater than a sum of the force of the spring and a force being exerted on a third inlet surface by the pressurized fluid when it increases again, the piston-cylinder unit being returnable from the memory position to the rest position by eliminating the pressure acting on the pressure surface facing away from the restoring spring.

5. A safety valve according to claim 4, wherein the pressure surface on the side facing away from the at least one restoring spring is formed by an actuating membrane of the piston-cylinder unit.

6. A safety valve according to claim 4, wherein the pressure surface on the side facing away from the at least one restoring spring is a sealing element of the piston of the piston-cylinder unit.

7. A safety valve according to claim 6, wherein the sealing element is a lip ring.

8. A safety valve according to claim 4, wherein the piston-cylinder unit has at least two ports, a first one of the ports being connected to atmosphere, and a second one of the ports being connected, when the piston-cylinder unit is in the rest position, to a third one of the ports leading to the pressure surface facing the at least one restoring spring, and being connected to the first port which is connected to the atmosphere when the piston-cylinder unit is in the memory position.

9. A safety valve according to claim 4, and further comprising a solenoid valve operatively arranged so as to decrease the force of the pressure acting on the pressure surface facing away from the at least one restoring spring.

10. A safety valve according to claim 4, and further comprising a mechanically actuated valve operatively arranged so as to decrease the force of the pressure acting on the pressure surface facing away from the at least one restoring spring.

* * * * *